US010969095B2

(12) United States Patent
Coelho

(10) Patent No.: US 10,969,095 B2
(45) Date of Patent: Apr. 6, 2021

(54) LIGHTING SYSTEM AND METHOD

(71) Applicant: Masterspas, LLC, Fort Wayne, IN (US)

(72) Inventor: Nathan Coelho, Leo, IN (US)

(73) Assignee: Masterspas, LLC, Fort Wayne, IN (US)

( * ) Notice: Subject to any disclaimer, the term of this patent is extended or adjusted under 35 U.S.C. 154(b) by 0 days.

(21) Appl. No.: 15/949,920

(22) Filed: Apr. 10, 2018

(65) Prior Publication Data

US 2018/0299115 A1 Oct. 18, 2018

Related U.S. Application Data

(60) Provisional application No. 62/483,721, filed on Apr. 10, 2017.

(51) Int. Cl.
*F21V 19/00* (2006.01)
*F21S 41/19* (2018.01)
(Continued)

(52) U.S. Cl.
CPC ..... *F21V 33/006* (2013.01); *B63B 29/18* (2013.01); *B63B 45/06* (2013.01); *E04H 4/0043* (2013.01); *E04H 4/148* (2013.01); *F21S 41/192* (2018.01); *F21V 15/01* (2013.01); *F21V 19/004* (2013.01); *F21V 19/005* (2013.01); *F21V 19/0045* (2013.01); *F21V 21/0808* (2013.01); *F21W 2131/401* (2013.01); *F21Y 2103/10* (2016.08); *F21Y 2115/10* (2016.08)

(58) Field of Classification Search
CPC ..... F21V 33/006; F21V 15/01; F21V 19/004; F21V 19/0045; F21V 19/005; F21V 21/0808; B63B 29/18; B63B 45/06; F21S 41/192; E04H 4/0043; E04H 4/148
See application file for complete search history.

(56) References Cited

U.S. PATENT DOCUMENTS 4,342,071 A * 7/1982 Chamberlain ..... F21V 25/12 362/158
4,780,917 A 11/1988 Hancock
(Continued)

FOREIGN PATENT DOCUMENTS

CN 203097349 U 7/2003
CN 103993757 A 8/2014
(Continued)

OTHER PUBLICATIONS

"The Best Backyard Hot Tub Ideas for Your Fun Backyard," Homes Corner, homescorner.com http://homescorner.com/thebestbackyardhot-tubideasforyourfunbackyard, Dec. 29, 2014.
(Continued)

*Primary Examiner* — Anabel Ton
(74) *Attorney, Agent, or Firm* — Kaplan Breyer Schwarz, LLP

(57) ABSTRACT

A lighting system includes a substrate of non-absorbent foam material having a first surface, an undercut groove formed in the first surface, and a light source disposed in the undercut groove. The lighting system can be used with various structures including, but not limited to spas, swimming pools, decks, marine products, and sheds.

26 Claims, 9 Drawing Sheets

(51) Int. Cl.

| | |
|---|---|
| ***F21V 15/01*** | (2006.01) |
| ***B63B 29/18*** | (2006.01) |
| ***B63B 45/06*** | (2006.01) |
| ***F21V 33/00*** | (2006.01) |
| ***F21V 21/08*** | (2006.01) |
| ***E04H 4/14*** | (2006.01) |
| ***E04H 4/00*** | (2006.01) |
| *F21Y 115/10* | (2016.01) |
| *F21W 131/401* | (2006.01) |
| *F21Y 103/10* | (2016.01) |

(56) References Cited

U.S. PATENT DOCUMENTS 5,887,856 A * 3/1999 Everly, II ..... E04H 17/00 256/1
6,012,254 A * 1/2000 Gaston ..... F21V 21/0824 52/102
6,027,280 A * 2/2000 Conners ..... E01C 17/00 362/153.1
6,467,103 B1 10/2002 Gardenier et al.
6,601,247 B2 8/2003 Shimizu
6,782,309 B2 8/2004 Laflamme et al.
6,874,175 B2 4/2005 Laflamme et al.
6,915,535 B2 7/2005 Sieger et al.
7,712,913 B2 5/2010 Gardenier et al.
8,296,873 B2 10/2012 Dragovich
8,388,214 B1 * 3/2013 Toro ..... F21V 33/006 362/648
8,453,275 B2 6/2013 May et al.
8,644,960 B2 2/2014 Laflamme et al.
8,678,613 B2 * 3/2014 Pickard ..... F21S 8/02 362/230
9,741,273 B1 * 8/2017 Curtis ..... G02B 5/0278
10,532,758 B2 * 1/2020 Barenbrug ..... B62B 9/20
2004/0179358 A1 * 9/2004 Tufte ..... B60Q 1/32 362/223
2005/0213342 A1 * 9/2005 Tufte ..... G09F 13/20 362/551
2006/0137087 A1 6/2006 Carreau et al.
2008/0098509 A1 5/2008 Kantor et al.
2008/0151555 A1 * 6/2008 Jo ..... H01J 11/12 362/330
2009/0064404 A1 3/2009 Frei
2009/0147504 A1 * 6/2009 Teeters ..... F21S 2/005 362/153
2009/0211012 A1 8/2009 Walker et al.
2009/0264041 A1 10/2009 Van Diep et al.
2011/0242803 A1 * 10/2011 Van Herpen ..... D05C 17/023 362/217.01
2011/0271436 A1 11/2011 Kite
2013/0033854 A1 * 2/2013 Statham ..... F25D 27/00 362/154
2013/0265797 A1 * 10/2013 Destieu ..... B60Q 3/64 362/565
2014/0119004 A1 * 5/2014 Yuan ..... F21L 14/023 362/231
2014/0185293 A1 * 7/2014 Ayotte ..... E04F 19/02 362/249.02
2015/0049476 A1 * 2/2015 Hsia ..... F21S 8/00 362/223
2015/0062875 A1 * 3/2015 Gou ..... B29D 35/02 362/103
2015/0075044 A1 * 3/2015 Nelson ..... G09F 13/0413 40/489
2015/0267899 A1 * 9/2015 Baright ..... F21V 19/004 362/223
2016/0178145 A1 * 6/2016 Oleske ..... F21V 21/04 52/28
2016/0184181 A1 6/2016 Walker et al.
2016/0213561 A1 7/2016 McLane et al.

FOREIGN PATENT DOCUMENTS

DE 102010037868 B3 1/2012
FR 2968028 A1 6/2012

OTHER PUBLICATIONS

"Wave Spa," Aquavia Spa, aquaviaspa.com, Apr. 9, 2016, https://web.archive.org/web/20160409050246/http://aquaviaspa.com/en/buy-spas/exclusive/wave-spa-an-outdoor-and-indoor-hot-tub/.
Made-in-China.com™, made-in-china.com, Foshan Talent SPA Equipment Co., Ltd., https://web.archive.org/web/20160609202800/http://perfect-spa.en.made-in-china.com/, Jun. 9, 2016.
Northern Star Hot Tub: 6Person 45Jet Hot Tub with Ozone, Lounger, Multi-Colored Mood Lighting and Waterfalls, Starlight Hot Tubs™, http://starlighthottubs.com/northernstarhottub/, Apr. 1, 2017.

* cited by examiner

LIGHTING SYSTEM AND METHOD

RELATED APPLICATIONS

This application claims the benefit of U.S. Provisional Application No. 62/483,721, filed on Apr. 10, 2017, the entire disclosure of which is incorporated herein by reference.

FIELD

The present disclosure relates to a lighting system and more particularly to a lighting system for a structure including, but not limited to a spa, a swimming pool, a deck, a marine product, and a shed.

BACKGROUND

Spas, swimming pools, pool decking, and boats typically have lights that enhance their aesthetics. In addition, the lights allow for safer use of spas, swimming pools, decking, boats and other marine products.

Therefore, it would be desirable to provide a lighting system that can be easily attached to or integrated with various structures.

SUMMARY

Disclosed herein is a lighting system for a structure including but not limited to a spa, swimming pool, deck, marine product, or shed. The lighting system comprises a substrate of non-absorbent foam material having a first surface and an undercut groove formed in the first surface, and a light source disposed in the undercut groove.

In some embodiments, the lighting system further includes a controller for controlling the operation of the light source.

In some embodiments, the substrate of non-absorbent foam material has a second surface opposite the first surface, the second surface including an adhesive for attaching the substrate of non-absorbent foam material to a structure.

In some embodiments, the light source comprises a light strip.

In some embodiments, the light source comprises a laser light strip.

In some embodiments, the light source comprises a light emitting diode.

In some embodiments, the light source comprises a strip of light emitting diodes.

In some embodiments, the light source comprises an incandescent lamp.

In some embodiments, the light source comprises a strip of incandescent lamps.

In some embodiments, the light source comprises a halogen lamp.

In some embodiments, the light source comprises a strip of halogen lamps.

In some embodiments, the light source comprises a xenon lamp.

In some embodiments, the light source comprises a strip of xenon lamps.

In some embodiments, the light source comprises an electric luminescent light strip.

In some embodiments, the substrate of non-absorbent foam material has a length, and wherein the undercut groove extends the length of the substrate of non-absorbent foam material or less than the length of the substrate of non-absorbent foam material.

In some embodiments, the undercut groove is continuous.

In some embodiments, the undercut groove is segmented.

In some embodiments, the undercut groove has at least one of a straight segment, a curved segment, a wavy segment or any combination thereof.

In some embodiments, the substrate of non-absorbent foam material has at least one of a straight segment, a curved segment, a wavy segment, or any combination thereof.

In some embodiments, the substrate of non-absorbent foam material has at least a second undercut groove formed in the first surface and a second light source disposed in the second undercut groove.

Further disclosed herein is a cabinet for a spa. The cabinet comprises at least one side panel having a surface and the lighting system described above. The substrate of non-absorbent foam material is coupled to the surface of the at least one side panel.

In some embodiments, the surface of the at least one side panel includes an indentation, the substrate of non-absorbent foam material disposed in the indentation and flush with the surface of the side panel.

Further disclosed herein is a spa comprising an internal frame structure, a spa shell held coupled with the frame structure, and the above described cabinet coupled to the frame structure.

Also disclosed herein is a marine product comprising the above described lighting system.

In some embodiments, the product comprises a boat.

BRIEF DESCRIPTION OF THE DRAWING

The disclosure is best understood from the following detailed description when read in conjunction with the accompanying drawing. It is emphasized that, according to common practice, the various features of the drawing are not necessarily to scale. On the contrary, the dimensions of the various features may be arbitrarily expanded or reduced for clarity. Like numerals denote like features throughout the specification and the drawing.

DETAILED DESCRIPTION

Figure 1A:
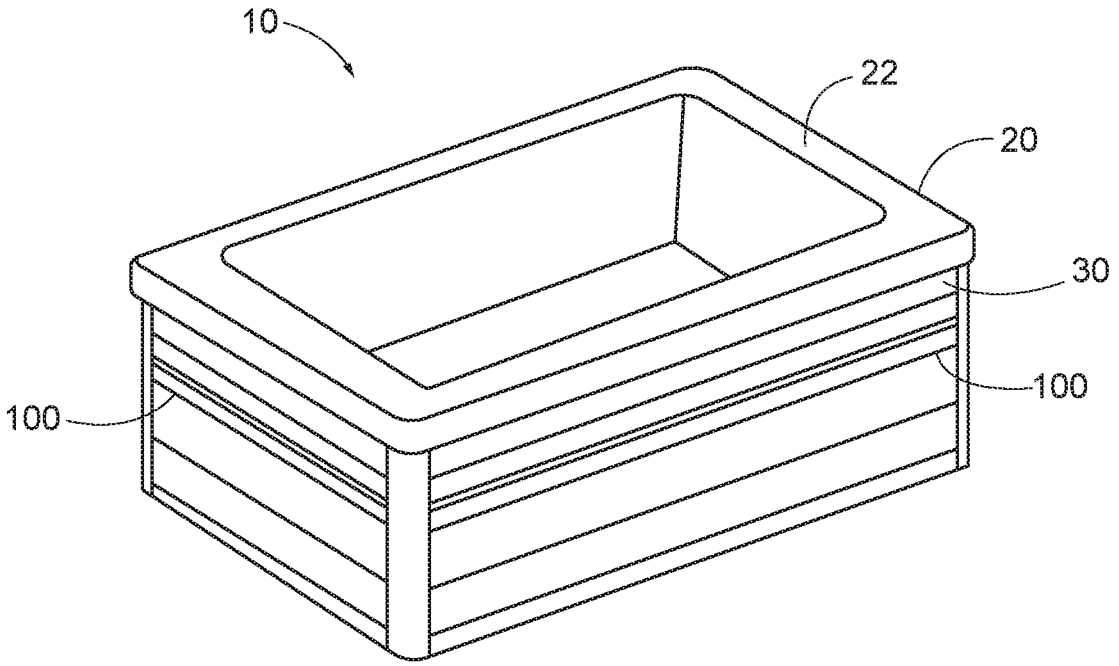
FIG. 1A is a perspective view depicting a lighting system of the present disclosure used with a conventional spa.

The disclosure is best understood from the following detailed description when read in conjunction with the accompanying drawing. It is emphasized that, according to common practice, the various features of the drawing are not necessarily to scale. On the contrary, the dimensions of the various features may be arbitrarily expanded or reduced for clarity. Like numerals denote like features throughout the specification and the drawing.

Figure 1B:
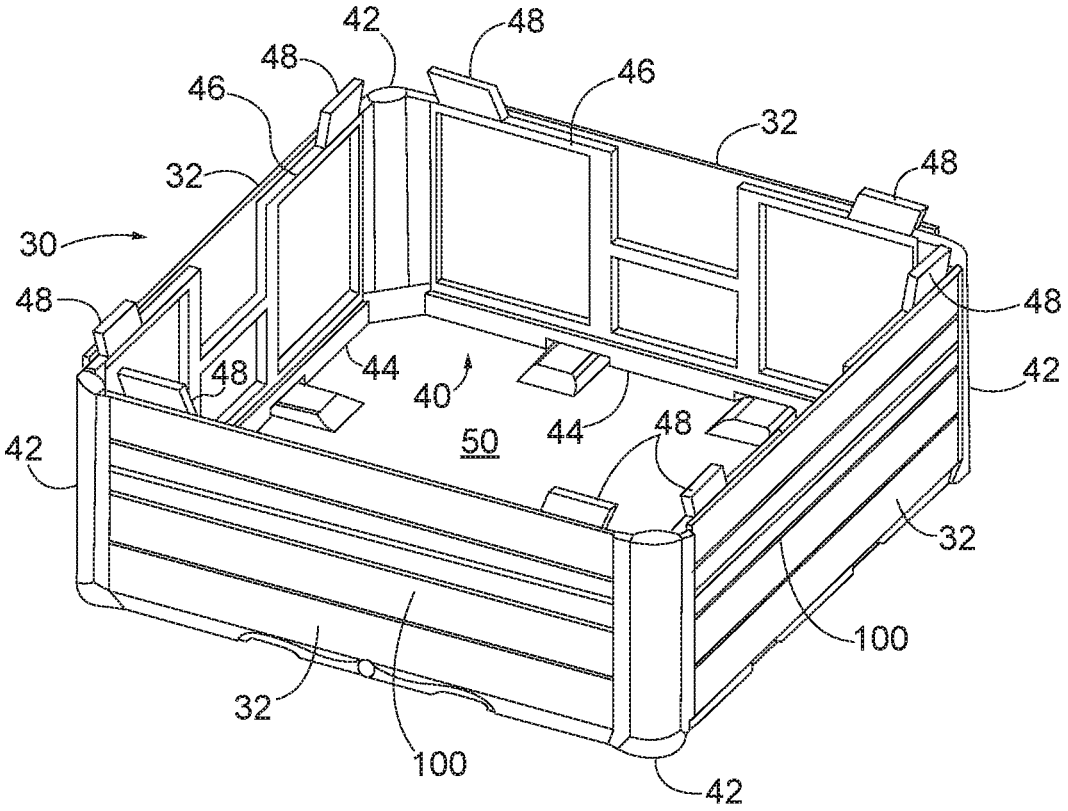
FIG. 1B is a perspective view of the spa of FIG. 1A with the shell of the spa removed from the cabinet of the spa.

FIGS. 1A and 1B collectively depict a lighting system of the present disclosure used with a conventional spa 10. As shown in FIG. 1A, the spa 10 has a spa shell 20, a spa cabinet 30 and the lighting system of the present disclosure denoted by reference numeral 100. The spa shell 20 is typically made of a vacuum formed, continuous cast acrylic sheet, which is reinforced with fiberglass. One of ordinary skill in the art will of course recognize that the spa shell 20 can be made of other suitable materials including but not limited to gel coated fiberglass or stainless steel.

As shown in FIG. 1B, the spa cabinet 30 includes side panels or skirts 32, which are attached to and supported by a frame 40. The spa cabinet 30 encloses the frame 40 and other components of the spa including but not limited to a pump system and a plumbing system (not shown). The spa cabinet 30 can be made of an opaque thermoplastic material, such as Acrylonitrile Butadien Styrene (ABS) or a wood, such as redwood or cedar.

Referring still to FIG. 1B, the frame 40 includes vertical corner frame members 42, base frame members 44 and side frame members 46. The base frame members 44 and side frame members 46 are coupled to adjacent ones of the corner frame members 42. The side frame members 46 may also be coupled to their underlying base frame members 44. The side frame members 46 each include a pair of shell support members 48, which support an outer rim 22 of the spa shell 20, as shown in FIG. 1A. The frame 40 can be fabricated from wood, a composite material, or other suitable materials. The frame 40 can sit on a tray 50 that isolates the frame 40 from the surface on which the spa 10 is placed. The tray 50 can be made of a plastic material, a composite material, a metal material, or other suitable materials.

Figure 2A:
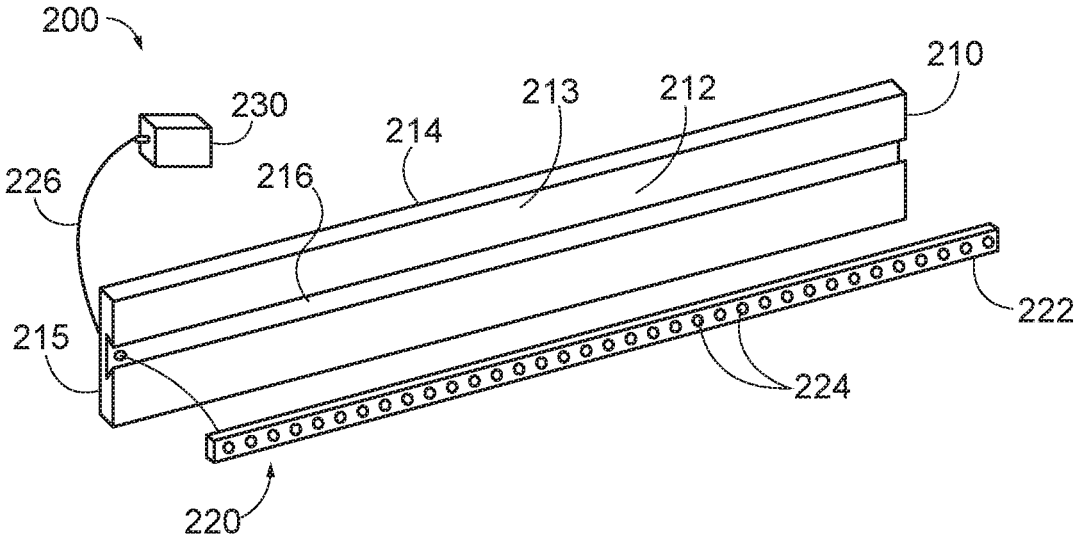
FIG. 2A is an exploded front perspective view of an illustrative embodiment of the lighting system of the present disclosure.
Figure 2B:
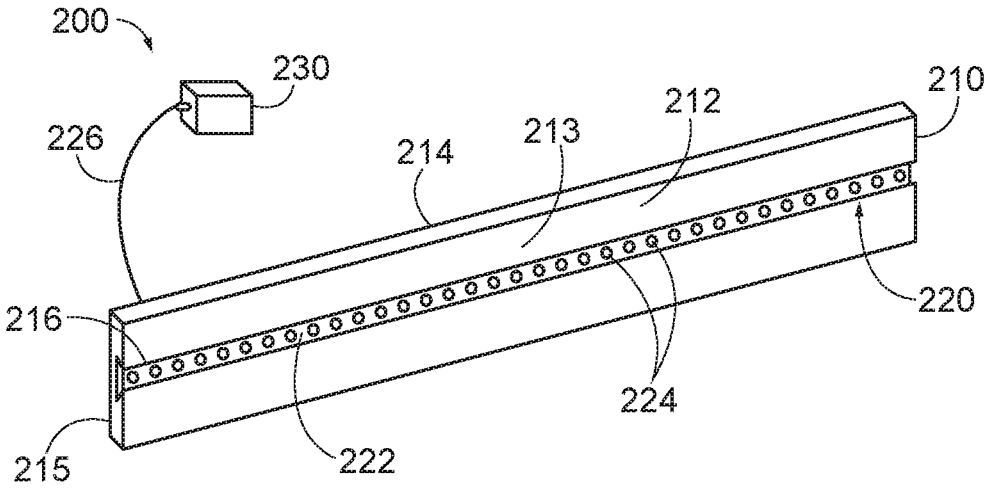
FIG. 2B is a front perspective view of the lighting system of FIG. 2A.

FIGS. 2A and 2B collectively depict an illustrative embodiment of the lighting system of the present disclosure denoted in FIGS. 2A and 2B by reference numeral 200. As shown, the lighting system 200 comprises a thin ribbon-like substrate of non-absorbent foam material 210 (foam substrate 210), a light source 220, and a controller 230 for controlling the operation of the light source 220. The foam substrate 210 has a front side 212 and a back side 214 opposite the front side 212. The front side 212 of the foam substrate 210 can have a flat and smooth surface, as shown in FIGS. 2A and 2B. In other embodiments, the front side 212 of the foam substrate 210 can have a convex, concave, or wavy surface 213 that is smooth or textured. The back side 214 of the foam substrate 210 is typically but not limited to a flat and smooth surface 215 and can include a thin layer of adhesive material (not visible) to enable the lighting system 200 to be attached to the exterior surface of a corresponding one of the cabinet side skirts, as shown, for example, in FIGS. 1A and 1B. The exterior surface of side skirt can include an indentation which is dimensioned and shaped to receive the foam substrate 210 so that it is flush with the exterior surface of the side skirt. In other embodiments, the lighting system can be attached to the spa shell 20 to illuminate the interior of the spa 10. The foam substrate 210 can be a closed cell foam material, such as ethylene vinyl acetate (EVA), crosslinked polyethylene, neoprene, or any other non-absorbent material that is sufficiently elastic to allow the light source 220 to be inserted into the undercut groove 216 and held therein without the use of additional fastening means. The foam substrate 210 can be 5 mm to 12 mm thick, although foam substrates of other thicknesses can be used. The foam substrate 210 can also be a laminate of two or more substrates of either the same or different foam materials.

Referring still to FIGS. 2A and 2B, the front side 212 of the foam substrate 210 includes an undercut groove 216 formed in surface 213 for securely receiving and retaining the light source 220 therein. The light source 220, in one embodiment, comprises a rigid or flexible strip 222 of light emitting diodes (LEDs). LED strip 222 includes at least one and preferably a plurality of individual LEDs 224 depending upon the desired length of the light source 220. The LEDs 224 can all be the same color or of different colors. At one end of the LED strip 222 is a wire 226 for connecting the LED strip 222 to the controller 230 that controls the operation of the LEDs 224 of the LED strip 222. The wire 226 can extend out through the back side 214 of the foam material 210. The wire 226 typically passes through an opening (not shown) extending through the corresponding side skirt of the spa cabinet, so that it can be connected with the controller 230, which is preferably enclosed within the spa cabinet. Because the LED strip 222 can be selected or cut to a desired length, various light patterns can be created in the foam substrate 210. Flexible versions of the LED strip 222 allow curving light patterns. The lighting source 220, in other embodiments, can comprise a laser light strip (e.g., laser light diffusing fiber technology), an incandescent lamp or a rigid or flexible strip of incandescent lamps, a halogen lamp or a rigid or flexible strip of halogens lamps, a xenon lamp or a rigid flexible strip of xenon lamps, an electric luminescent light strip (also referred to as an EL wire), or any other suitable lamp or strip of lamps.

In some embodiments, the controller 230 is located within the spa cabinet and connected to the spa electronics, which supply the system 200 with electrical power. In some embodiments, the system 200 can include a photocell sensor (not shown) connected to the controller 230. The photocell sensor is located external to the spa so that it can detect environmental light (e.g., sunlight). When the level of environmental light sensed by the photocell sensor drops below a predetermined value, the controller is adapted to energize (turn-on) the light source of the system 200. When the level of environmental light sensed by the photocell sensor exceeds the predetermined value, the controller is adapted to de-energize (turn-off) the light source of the system 200. In some other embodiments, the system 200 can also or alternatively include a motion sensor (not shown) connected to the controller 230. The motion sensor is located external to the spa so that it can detect motion (e.g., a user). When motion is sensed by the motion sensor, the controller is adapted to energize (turn-on) the light source of the system 200. When no motion is sensed by the motion sensor, the controller is adapted to de-energize (turn-off) the light source of the system 200.

Figure 3:
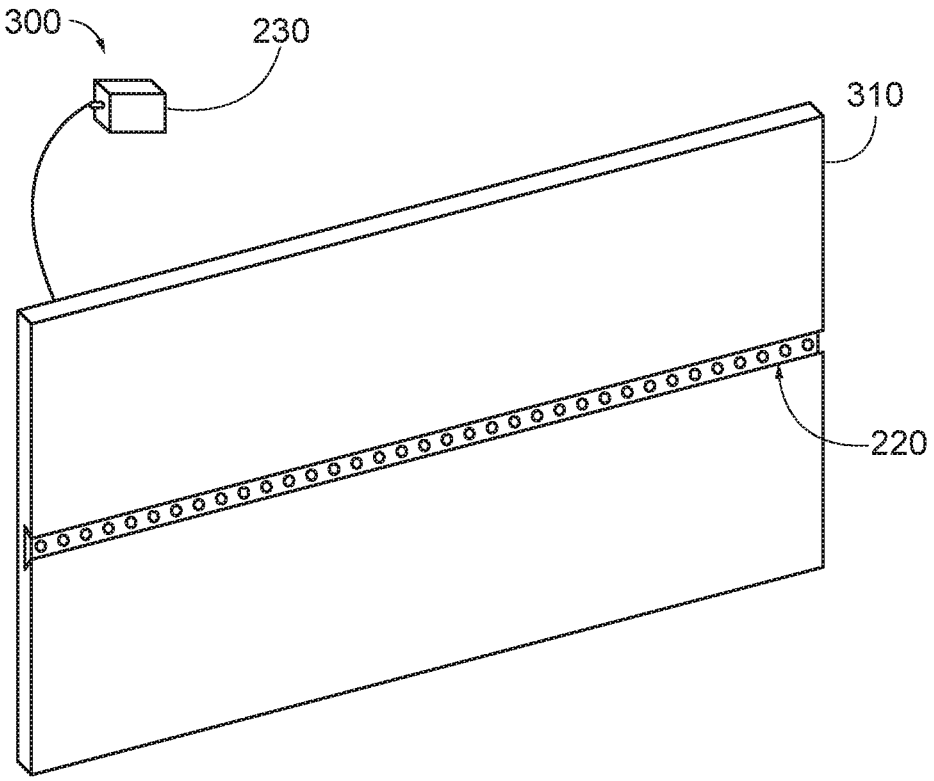
FIG. 3 is a front perspective view of another illustrative embodiment of the lighting system of the present disclosure.
Figure 4A:
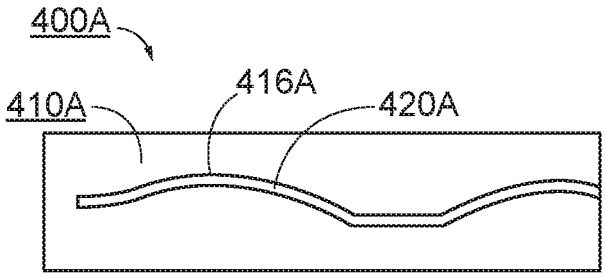
FIG. 4A is a top plan view of another illustrative embodiment of the lighting system of the present disclosure.
Figure 4B:
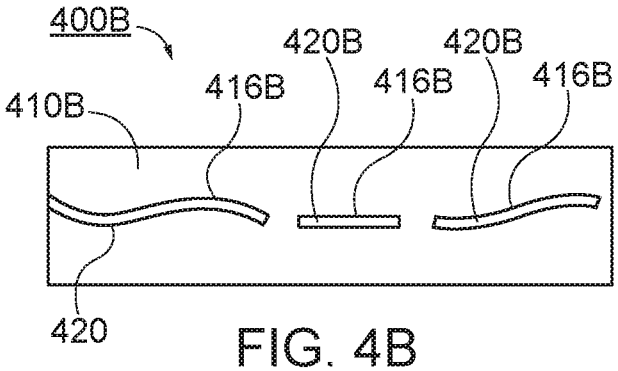
FIG. 4B is a top plan view of another illustrative embodiment of the lighting system of the present disclosure.
Figure 4C:
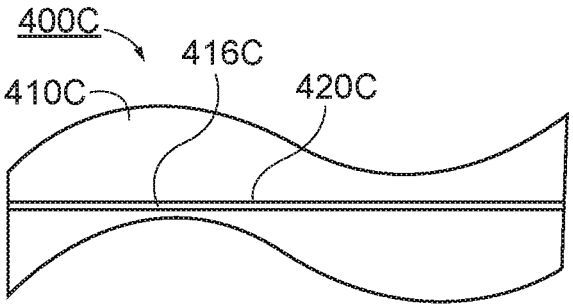
FIG. 4C is a top plan view of another illustrative embodiment of the lighting system of the present disclosure.
Figure 5:
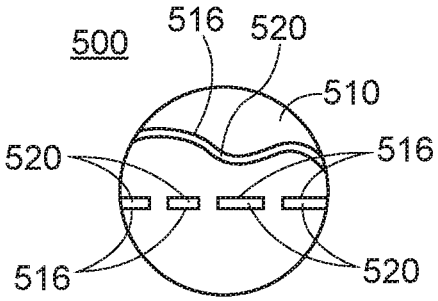
FIG. 5 is a top plan view of another illustrative embodiment of the lighting system of the present disclosure.

FIG. 3 depicts another illustrative embodiment of the lighting system of the present disclosure, denoted by reference numeral 300. The lighting system 300 depicted in FIG. 3 is substantially identical to the lighting system 200 depicted in FIGS. 2A and 2B, except that the lighting system 300 comprises a thin sheet-like foam substrate 310 instead of the thin ribbon-like form substrate 210 used in the embodiment of the lighting system of FIGS. 2A and 2B.

One of ordinary skill in will appreciate that the foam substrate, the light source, or both the foam substrate and the light source, can each be configured in any desired shape or pattern. FIGS. 4A-4C and FIG. 5 depict various other non-limiting illustrative embodiments of the lighting system of the present disclosure. The lighting system 400A of FIG. 4A comprises a foam substrate 410A and 410B that extends linearly, and an undercut groove 416A and a light source 420A that extend in a continuous linear and wavy manner. The lighting system 400B of FIG. 4B comprises a foam substrate 410B that extends linearly, and an undercut groove 416B and a light source 420B that extend in a segmented linear and wavy manner. The lighting system 400C of FIG. 4C comprises a foam substrate 410C that extends in a wavy manner, and an undercut groove 416C and a light source 420C that extend in a continuous linear manner. The lighting system 500 of FIG. 5 comprises a circular foam substrate 510, and a first undercut groove 516A and a first light source 520A that extend in a continuous wavy manner and a second undercut groove 516B and a second light source 520B the extend in a segmented linear manner. In other embodiments, the foam substrate and undercut groove and light source can each be configured in a geometrical shape, an irregular shape, as a number, a letter, a word, or any combination thereof and have any desired length and width.

Figure 6A:
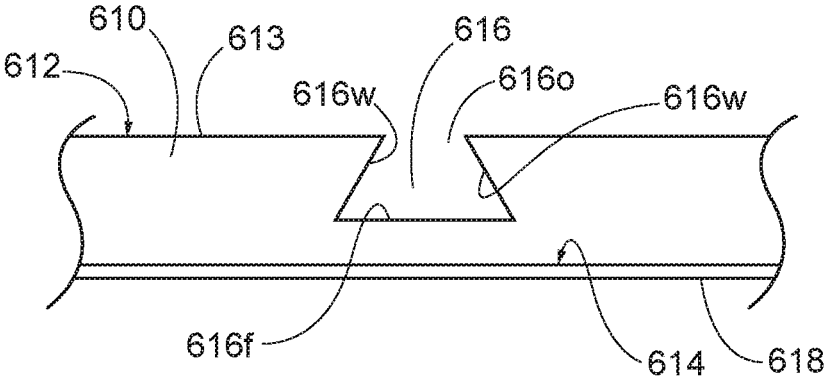
FIG. 6A is an end view of an embodiment of the undercut groove.
Figure 6B:
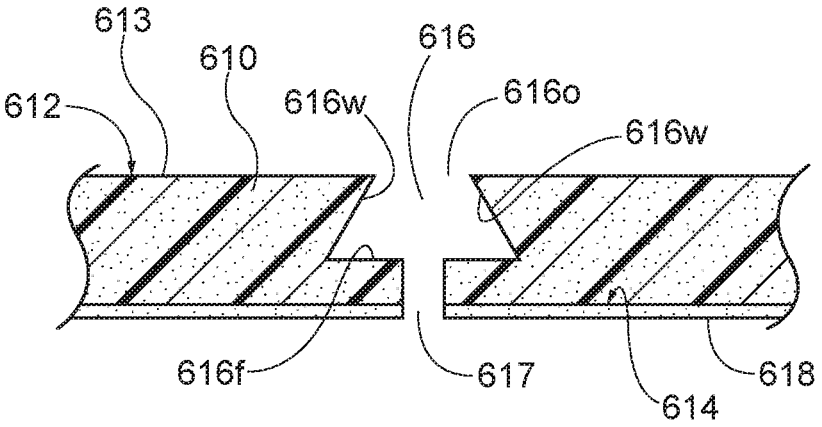
FIG. 6B is a sectional view of the undercut groove of FIG. 6A.

FIGS. 6A and 6B collectively depict an illustrative embodiment of the undercut groove of the present disclosure denoted by reference numeral 616. The undercut groove 616 formed in surface 613 on the front side 612 of the foam material 610 and has a dovetail structure comprising an opening 616*o*, a floor 616*f* opposite the opening 616*o*, and opposing undercut walls 616*w* extending from the opening 616*o* to the floor 616*f*. As shown in cross-section in FIG. 6B, an opening is provided in the floor 616*f* of the groove 616 and the thin layer of adhesive material 618 disposed on the back side 614 of the foam material 610, which allows the wire 626 of the light source 620 (FIGS. 6C and 6D) to pass through the foam substrate 610 and connect with the controller (not shown), which is enclosed in the cabinet of the spa. The undercut groove 616 can be formed in surface 613 of the foam substrate 610 using any conventional foam milling method.

Figure 6C:
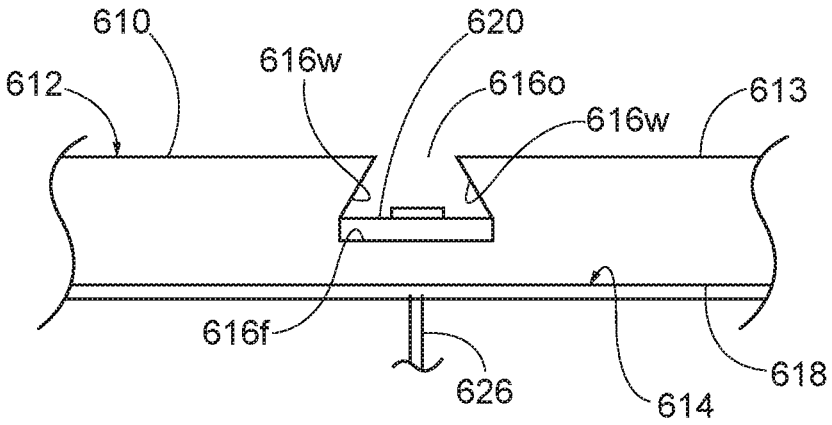
FIG. 6C is an end view illustrating a light source positioned within the undercut groove of FIG. 6A.
Figure 6D:
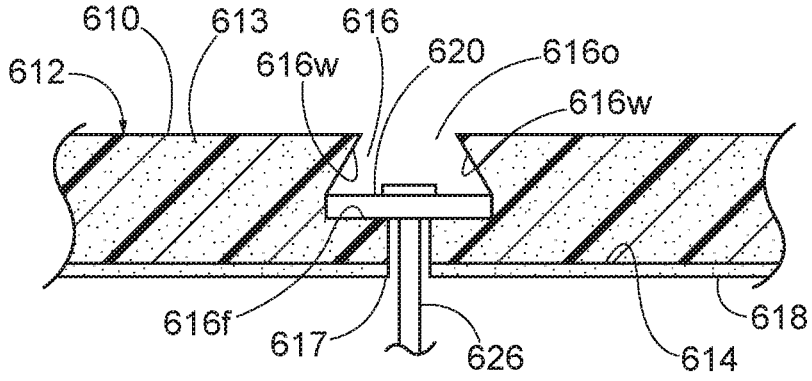
FIG. 6D is a sectional view illustrating the light source positioned within the undercut groove of FIG. 6C.

The light source 620 has a width that is equal to or slightly greater than the maximum width of the undercut groove 616. The elastically flexible nature of the foam substrate 610 compresses to allow the undercut groove 616 to expand and receive the light source 620 as it is inserted through the opening 616*o* of the groove 616 and pressed down toward the floor 616*f* to position the light source 620 in the groove 616. As shown in FIGS. 6C and 6D, the undercut groove 616 expands and substantially returns to its original shape when the light source 620 is positioned adjacent the floor 616*f* of the groove 616. Accordingly, the undercut walls 616*w* of the groove 616 securely hold the light source 620 in the groove 616 without the use of any additional fastening means, such as screw fasteners or adhesives, thereby coupling the light source 620 to the foam substrate 610.

Figure 7A:
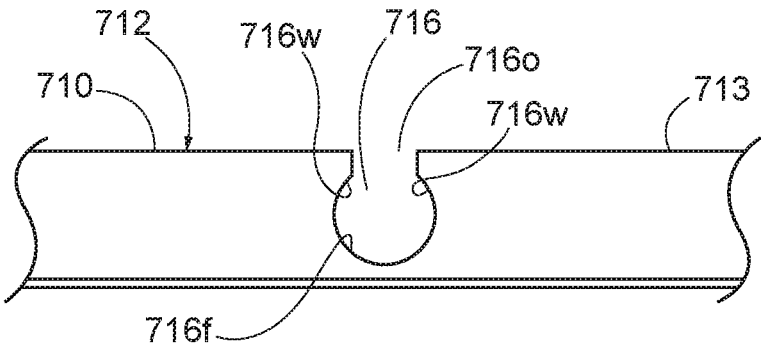
FIG. 7A is an end view of another embodiment of the undercut groove.
Figure 7B:
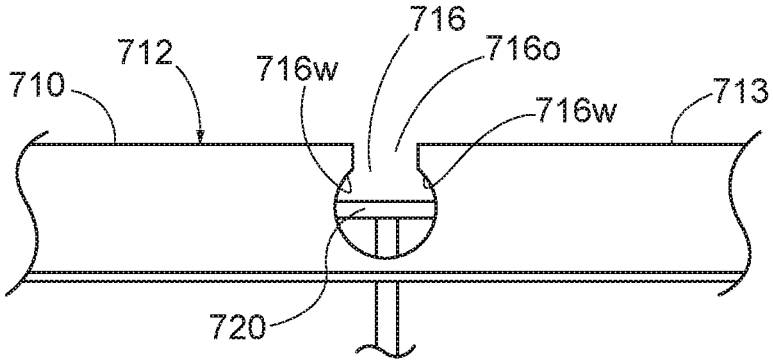
FIG. 7B is a sectional view of the undercut groove of FIG. 7A.

The structure of the undercut groove is not limited to that shown in FIGS. 6A-6D, and can have any other suitable structure for accommodating and retaining the structure of the corresponding light source. For example, but not limitation, FIGS. 7A and 7B collectively depict another illustrative embodiment of the undercut groove of the present disclosure denoted by reference numeral 716. The undercut groove 716 formed in surface 713 on the front side 712 of the foam substrate 710 comprises a C-shape structure having an opening 716*o*, a curved floor 716*f* opposite the opening 716*o* and opposing curved undercut walls 716*w* extending from the groove opening 716*o* to the curved groove floor 716*f*. The C-shape undercut groove 716 would be appropriate for use with, for example, a round light strip, such as an EL wire, whereas the dovetail shape undercut groove 616 described earlier would be appropriate for use with, for example, a flat or rectangular light strip, such as an LED strip. The curved undercut walls 716*w* of the groove 716 securely hold the light source 720 within the groove 716 without the use of any additional fastening means, as in the embodiment of FIGS. 6A-6D.

Figure 8:
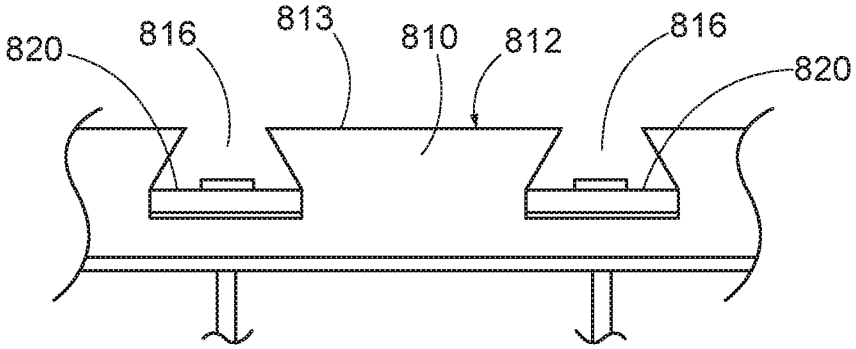
FIG. 8 is an end view illustrating two undercut grooves each having a light source positioned therein.

In other embodiments, the foam substrate can include several grooves each of which contains a light source. For example, but not limitation, FIG. 8 depicts two undercut grooves 816 formed in surface 813 on the front side 812 of a foam substrate 810. Each undercut groove 816 holds a light source 820.

Figure 9:
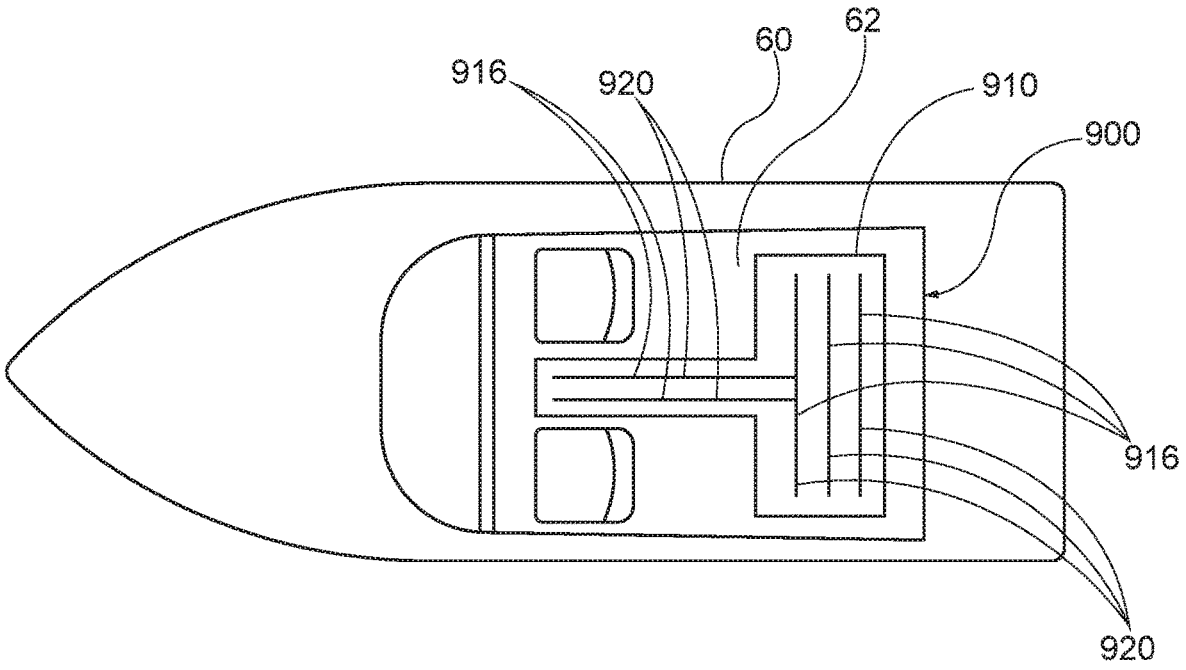
FIG. 9 is a top plan view depicting an illustrative embodiment of the lighting system of the present disclosure used with a conventional boat.

FIG. 9 depicts an illustrative embodiment of the lighting system 900 of the present disclosure used with a boat 60. The lighting system 900 includes foam substrate 910 attached to a floor 62 or other surface of the boat 60, a plurality of undercut grooves 916, and a plurality of light sources 920 held in the undercut groove 916.

One of ordinary skill in the art will appreciate that the lighting system of the present disclosure can also be used for illuminating other structures including, but not limited to swimming pools, decks, other marine products, and sheds.

It should be understood that the invention is not limited to the embodiments illustrated and described herein. Rather, the appended claims should be construed broadly to include other variants and embodiments of the invention, which may be made by those skilled in the art without departing from the scope and range of equivalents of the invention. It is indeed intended that the scope of the invention should be determined by proper interpretation and construction of the appended claims and their legal equivalents, as understood by those of skill in the art relying upon the disclosure in this specification and the attached drawings.

What is claimed is:

1. A lighting system comprising:

an elastically flexible substrate of non-absorbent foam material having a first surface, a second surface opposite the first surface, an undercut groove formed in the first surface, and an adhesive disposed on the second surface for attaching the substrate of non-absorbent foam material to a structure; and a light source disposed in the undercut groove;

wherein the undercut groove has an opening that expands when the light source is inserted therethrough to dispose the light source in the undercut groove.

2. The lighting system of claim 1, wherein the light source comprises a light strip.

3. The lighting system of claim 1, wherein the light source comprises a light emitting diode.

4. The lighting system of claim 1, wherein the light source comprises a strip of light emitting diodes.

5. The lighting system of claim 1, wherein the light source comprises an incandescent lamp.

6. The lighting system of claim 1, wherein the light source comprises a strip of incandescent lamps.

7. The lighting system of claim 1, wherein the light source comprises a halogen lamp.

8. The lighting system of claim 1, wherein the light source comprises a strip of halogen lamps.

9. The lighting system of claim 1, wherein the light source comprises a xenon lamp.

10. The lighting system of claim 1, wherein the light source comprises a strip of xenon lamps.

11. The lighting system of claim 1, wherein the light source comprises an electric luminescent light strip.

12. The lighting system of claim 1, wherein the substrate of non-absorbent foam material has a length, and wherein the undercut groove extends the length of the substrate of non-absorbent foam material or less than the length of the substrate of non-absorbent foam material.

13. The lighting system of claim 12, wherein the undercut groove is continuous.

14. A lighting system comprising:

an elastically flexible substrate of non-absorbent foam material having a first surface, a second surface opposite the first surface, an undercut groove formed in the first surface, and an adhesive disposed on the second surface for attaching the substrate of non-absorbent foam material to a structure; and a light source disposed in the undercut groove;

wherein the undercut groove has an opening that expands when the light source is inserted therethrough to dispose the light source in the undercut groove; and wherein the undercut groove is segmented.

15. The lighting system of claim 1, wherein the undercut groove has at least one of a straight segment, a curved segment, a wavy segment, or any combination thereof.

16. The lighting system of claim 1, wherein the substrate of non-absorbent foam material has at least one of a straight segment, a curved segment, a wavy segment or any combination thereof.

17. A cabinet for a spa, the cabinet comprising:

a plurality of side panels each having a surface;

a frame structure including a plurality of frame members, the frame structure supporting the side panels, and the side panels forming an enclosure about the frame structure; and a lighting system comprising:

a substrate of non-absorbent foam material having a surface and an undercut groove formed in the surface of the substrate; and a light source disposed in the undercut groove;

wherein the substrate of non-absorbent foam material is coupled to the surface of the at least one of the side panels.

18. The cabinet of claim 17, wherein the surface of the at least one of the side panels includes an indentation, the substrate of non-absorbent foam material disposed in the indentation and flush with the surface of the at least one of the side panels.

19. The cabinet of claim 17, further comprising a controller for controlling the operation of the light source, the controller disposed within the cabinet.

20. A spa comprising:

the cabinet of claim 17; and a spa shell coupled to the frame structure of the cabinet.

21. The lighting system of claim 1, further comprising a controller for controlling the operation of the light source.

22. The lighting system of claim 1, wherein the light source comprises a laser light strip.

23. A marine product comprising:

a boat; and a lighting system attached to a surface of the boat, the lighting system comprising:

an elastically flexible substrate of non-absorbent foam material having a surface and an undercut groove formed in the surface of the substrate; and a light source disposed in the undercut groove;

wherein the undercut groove has an opening that expands when the light source is inserted therethrough to dispose the light source in the undercut groove.

24. The marine product of claim 23, wherein the surface of the boat is a floor of the boat.

25. A marine product comprising:

a boat; and a lighting system attached to a surface of the boat, the lighting system comprising:

an elastically flexible substrate of non-absorbent foam material having a surface and an undercut groove formed in the surface of the substrate; and a light source disposed in the undercut groove;

wherein the undercut groove has an opening that expands when the light source is inserted therethrough to dispose the light source in the undercut groove; and wherein the undercut groove is segmented.

26. The lighting system of claim 1, wherein the substrate of non-absorbent foam material has at least a second undercut groove formed in the first surface and a second light source disposed in the second undercut groove.

* * * * *